United States Patent [19]

Thelen

[11] Patent Number: 4,648,331

[45] Date of Patent: Mar. 10, 1987

[54] PROCESS FOR THE REDUCTION OF $NO_x$ IN FLUIDIZED-BED FURNACES

[75] Inventor: Franz Thelen, Mülheim, Fed. Rep. of Germany

[73] Assignee: Steag AG, Essen, Fed. Rep. of Germany

[21] Appl. No.: 708,060

[22] Filed: Mar. 4, 1985

[30] Foreign Application Priority Data

Mar. 2, 1984 [DE] Fed. Rep. of Germany ..... 3407689

[51] Int. Cl.[4] ..... F23B 7/00

[52] U.S. Cl. ..... 110/342; 110/343

[58] Field of Search ..... 110/341, 342, 343, 344, 110/345

[56] References Cited

U.S. PATENT DOCUMENTS 4,284,015 8/1981 Dickinson ..... 110/342 X
4,388,877 6/1983 Molayem et al. ..... 110/342

FOREIGN PATENT DOCUMENTS 2320304 11/1973 Fed. Rep. of Germany .
2401570 7/1974 Fed. Rep. of Germany .
2535357 2/1977 Fed. Rep. of Germany .
2852800 6/1979 Fed. Rep. of Germany .
0017217 2/1977 Japan ..... 110/342

OTHER PUBLICATIONS

"Schadstoffeinbeindung durch Additiveinblasung um die Flamme", *Brennst.-Warme-Kraft*, 35 (1983), No. 3, Marz, by M. Y. Chughtai and Michelfelder, Gummersbach, pp. 75-83.

*Primary Examiner*—Edward G. Favors
*Attorney, Agent, or Firm*—Young & Thompson

[57] ABSTRACT

In a process for lowering the $NO_x$ content in combustion waste gases with the use of a reducing agent, the reducing agent has heretofore been added in all cases to the combustion gases downstream of the incineration. According to the invention, it is suggested in a fluidized-bed incineration to introduce the reducing agent into the fluidized bed. It is preferred, in this connection, to admix reducing agent to the utilized fuel and/or to the combustion air and/or to introduce the reducing agent directly into the incineration. Especially preferred reducing agents are $NH_3$ or nitrogen-containing hydrocarbon compounds. Various additional versions of the feeding operation are possible.

3 Claims, 1 Drawing Figure

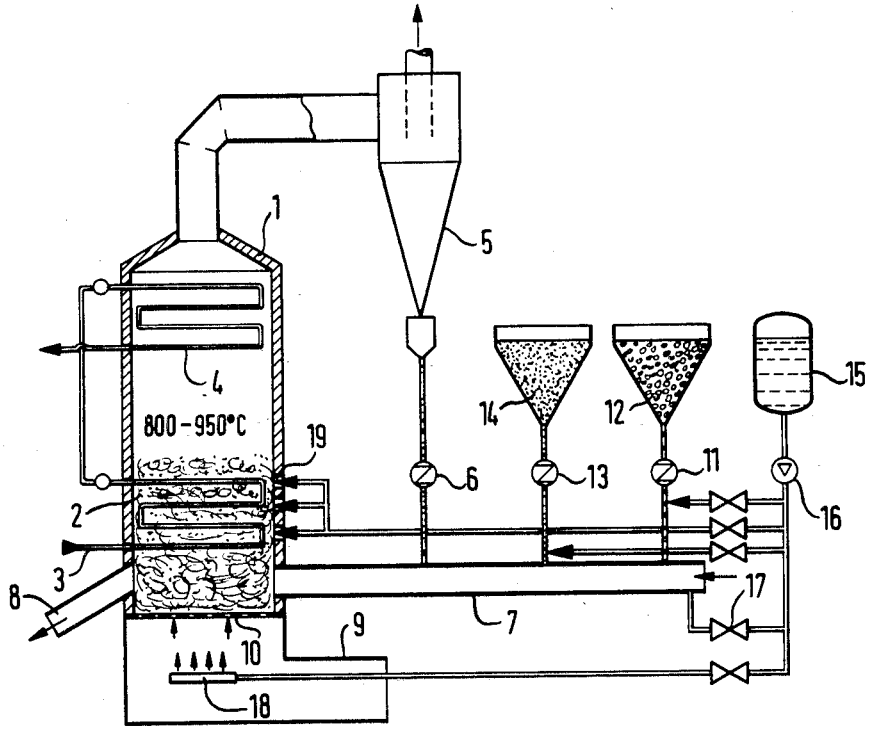
1
5
4
800-950°C
19
14
12
15
6
13
11
16
2
3
8
17
7
9
10
18

PROCESS FOR THE REDUCTION OF $NO_x$ IN FLUIDIZED-BED FURNACES

The invention relates to a process for reducing the $NO_x$ content in combustion waste gases with the use of a reducing agent.

It is known (German Pat. No. 2,320,304), for reducing the $NO_x$ content in combustion waste gases with the use of a reducing agent in the presence of oxygen, to catalytically contact the waste gas stream with hydrocarbons, oxygen-containing hydrocarbons, nitrogen-containing hydrocarbons, halogen-containing hydrocarbons or sulfur-containing hydrocarbons in the presence of oxygen at a temperature of 400°-2700° C. in order to reduce the $NO_x$ to molecular nitrogen.

The reducing agent thus is not added to the furnace where the combustion waste gases are produced, but rather downstream of the incinerating plant.

A process has been known from German Pat. No. 2,852,800 wherein ammonia is added to the combustion gas for the removal of nitrogen oxides from this combustion gas. In this gaseous-phase reducing process, the reaction temperatures required for $NO_x$ reduction range around at least 800° C. The reducing agent is added also in this case to the waste gases downstream of the incineration.

It is an object of the present invention to employ a process of the aforementioned type which is particularly suited for utilization in fluidized-bed incinerations.

This object has been attained, in a fluidized-bed incineration, by introducing the reducing agent into the fluidized bed.

In stationary or circulating fluidized-bed furnace operations, the average combustion temperatures in the fluidized bed are, at about 800°-950° C., precisely within the temperature range wherein the $NO_x$ present is reduced in the presence of the reducing agent. By feeding the reducing agent into the fluidized bed charged with combustion air, a uniform distribution of the reducing agent is obtained.

Preferably, reducing agent is admixed to the main mass streams for the incineration, namely the utilized fuel and/or the combustion air and/or it is introduced directly into the incineration.

The reducing agent, present in an especially preferred way in the form of $NH_3$ or nitrogen-containing hydrocarbon compounds, can be utilized in the gaseous form, in the solid phase, or in an aqueous solution; it is stored in pressurized containers, bins and/or tanks. However, it is also possible to employ the other hydrocarbon compounds set forth in the second paragraph of the specification.

If a desulfurizing agent, such as limestone, for example, is introduced into the incinerating process for desulfurizing, the reducing agent can also be added wholly or partially to the desulfurizing agent.

In case of introduction of the fuel into the incineration by means of conveying air, the provision can be made to add reducing agent to the conveying air.

The process of this invention will be described in greater detail with reference to the appended FIGURE, illustrating the large number of aforementioned versions for introducing the reducing agent into the fluidized bed. The preferred mode of introduction, or combinations of modes of introduction, is or are dependent on the individual incineration operation; however, preferred embodiments are the admixture to the fuel and/or to the combustion air and/or direct introduction into the fluidized bed.

The FIGURE shows a steam generator 1 with a stationary fluidized bed 2. The steam generator 1 comprises a pipe coil structure 3 fed with water and lying in the fluidized bed and a pipe coil structure 4 located downstream of the first-mentioned pipe coil structure and in the flue gas space of the steam generator. The flue gases exiting from the steam generator 1 are passed on to a cyclone separator 5 from which the dust-free flue gases are discharged in the upward direction while the precipitated dust is discharged via a metering means 6 into a charging conduit 7. Ash is removed from the fluidized bed via a conduit 8. Combustion air is introduced into the fluidized bed via a conduit 9; this air enters the fluidized bed by way of a perforated plate 10.

The charging conduit 7 is connected via a metering means 11 with a coal bin 12 and via a metering means 13 with a limestone bin 14.

A container 15 with an aqueous NH solution is connected by way of a conveying pump 16 and shut-off means 17 to the conduit arranged downstream of the metering means 11, to the conduit arranged downstream of the metering means 13, to the charging conduit 7, to a nozzle ring 18 underneath the perforated plate 10, and to several feed ports 19 in the wall of the steam generator 1.

The feed ports in the wall of the steam generator can be arranged in uniform distribution around the circumference of the steam generator.

It is to be emphasized that, in certain cases, a single version of the feeding process is adequate.

The average combustion temperature is indicated within the steam generator.

I claim:

1. A process for the reduction of $NO_x$ content in combustion waste gases, comprising introducing into the fluidized bed of a fluidized bed incineration, a reducing agent selected from the group consisting of $NH_3$ and a nitrogen-containing hydrocarbon compound, and maintaining the temperature of the fluidized bed about 800°-950° C.

2. A process as claimed in claim 1, in which said reducing agent is $NH_3$.

3. A process as claimed in claim 1, in which said reducing agent is an aqueous solution of $NH_3$.

* * * * *